United States Patent [19]

Yindra

[11] Patent Number: 4,586,398

[45] Date of Patent: May 6, 1986

[54] FOOT CONTROL ASSEMBLY FOR POWER-OPERATED TABLES AND THE LIKE

[75] Inventor: Leonard J. Yindra, Manitowoc, Wis.

[73] Assignee: Hamilton Industries, Two Rivers, Wis.

[21] Appl. No.: 537,344

[22] Filed: Sep. 29, 1983

[51] Int. Cl.[4] ..... G05G 1/14

[52] U.S. Cl. ..... 74/512; 200/153 C; 200/153 K; 200/86.5

[58] Field of Search ..... 74/512, 514; 200/153 C, 200/153 K, 86.5; 318/551; 269/324, 325

[56] References Cited

U.S. PATENT DOCUMENTS

| | | | |
|---|---|---|---|
| 513,213 | 1/1894 | Stanton | 318/551 |
| 804,595 | 11/1905 | Garhart | 200/153 C |
| 2,416,410 | 2/1947 | Shampaine | 311/7 |
| 2,535,021 | 12/1950 | Stone et al. | 74/512 |
| 2,707,036 | 4/1955 | Hollub | 74/512 |
| 2,747,056 | 5/1956 | Jefferson | 200/153 K |
| 3,046,071 | 7/1962 | Shampaine | 311/7 |
| 3,143,803 | 8/1964 | Lunn | 32/22 |
| 3,302,022 | 1/1967 | Brenner | 250/57 |
| 3,318,596 | 5/1967 | Herzog | 269/324 |
| 3,466,411 | 9/1969 | Martin | 200/86.5 |
| 3,486,747 | 12/1969 | Cardoso | 269/325 |
| 3,499,529 | 3/1970 | Katzfey | 269/325 |
| 3,631,242 | 12/1971 | Williams | 250/55 |
| 3,678,519 | 7/1972 | Szucs | 5/62 |
| 3,833,782 | 9/1974 | Bartel | 200/86.5 |
| 3,874,728 | 4/1975 | Weiland | 297/330 |
| 4,168,099 | 9/1979 | Jacobs et al. | 297/325 |

*Primary Examiner*—Kenneth J. Dorner

*Attorney, Agent, or Firm*—Tilton, Fallon, Lungmus

[57] ABSTRACT

A foot control assembly for use with power-driven equipment having reversible electrically-actuated operations such as, for example, power-operated medical examination tables and chairs. The assembly includes a base housing located along a floor surface adjacent to the equipment with which it is operatively connected. A plurality of actuating members are mounted upon the housing, such members being spaced laterally apart to define at least one operating station therebetween. Each station is wide enough to receive at least the front or toe portion of an operator's foot. The actuating members are horizontally movable and are shifted by lateral contact with an operator's foot to actuate either of a pair of reversible power operations associated with each station.

13 Claims, 11 Drawing Figures

ELEV
UP
DN
BACK
UP
DN
TILT
WD
REV
FOOT
UP
DN
20
21
22
24
25
26a
27a
27b
27c
27d
27e
28a
28b
28c
28d
29
30
31
32
33
33a
34
34a
10

FOOT CONTROL ASSEMBLY FOR POWER-OPERATED TABLES AND THE LIKE

BACKGROUND AND SUMMARY

Power operated multiple-position chairs and/or tables such as the type used for medical examinations and minor surgery are commonly equipped with foot control assemblies which allow the doctor, nurse, or attendant to direct the power operation to shift the unit into any of a variety of positions such as, for example, Trendelenburg position, reverse Trendelenburg position, urological examination position, proctological examination position, chair position, horizontal table position, etc. Ordinarily, the foot control unit has a number of pedals which may be depressed or rocked by foot action to activate the motors (electrical or hydraulic) for shifting the table or chair into the desired position. While the use of such a foot controller is highly advantageous, particularly where such adjustments are to be made while maintaining a sterile field, or without requiring the physician to shift his hands or eyes away from the area of examination while such adjustments are being made, there is nevertheless a significant risk that one or more pedals might be inadvertently depressed as the physician (or assistant) moves about the examination chair or table. To reduce the possibilities of accidental operation, guards or covers are sometimes provided over the foot pedals as shown, for example, in U.S. Pat. No. 4,168,099 (FIG. 7). Such a cover reduces but does not eliminate the problem and, in addition, increases the bulk of the foot control unit and reduces the ease and convenience of intentional operation. Other patents illustrative of the state of the art are U.S. Pat. Nos. 2,416,410, 3,046,071, 3,143,803, 3,302,022, 3,318,596, 3,466,411, 3,486,747, 3,499,529, 3,631,242, 3,678,519, and 3,874,728.

Accordingly, it is an object of this invention to provide a low-profile foot control assembly that has a plurality of actuating members for foot-directed operation of power-operated chairs, tables, or other equipment, and which greatly reduces the risk of accidental activation while, at the same time, avoiding the need for providing a protective cover or cage. Other objects of this invention include providing a controller that is easier to operate than conventional units with depressible foot pedals, and providing an assembly which may be operated without requiring the user to shift his (her) weight from one leg to the other or substantially alter the weight carried by the leg used to operate the controller.

Briefly, the foot control assembly takes the form of a base housing equipped with a plurality of actuating members or levers that are spaced laterally apart to define at least one operating station therebetween. Most advantageously, a multiplicity of such operating stations would be provided. Each station has a pair of actuating members along each side, the members being spaced far enough apart to receive at least the front or toe portion of an operator's foot therebetween. The actuating members are mounted upon the housing for lateral contact rather than the vertical contact and movement commonly found in foot control assemblies. To activate the power operated equipment to assume any selected or programmed position of adjustment or perform a selected operation, the user simply places his (her) foot at the appropriate operating station and then shifts it laterally one way or the other to engage one of the two actuating members bordering that station and thereby cause power operation of the equipment in one or the other of its reversible directions. The lateral movement of the operator's foot may be executed by pivoting the foot about the heel and without appreciably reducing the weight supported by that leg; hence, operation of the foot controller may be achieved with relatively little movement by an operator.

Other features, objects, and advantages of the invention will become more apparent from the specification and drawings.

DRAWINGS

DETAILED DESCRIPTION OF PREFERRED EMBODIMENT

Figure 1:
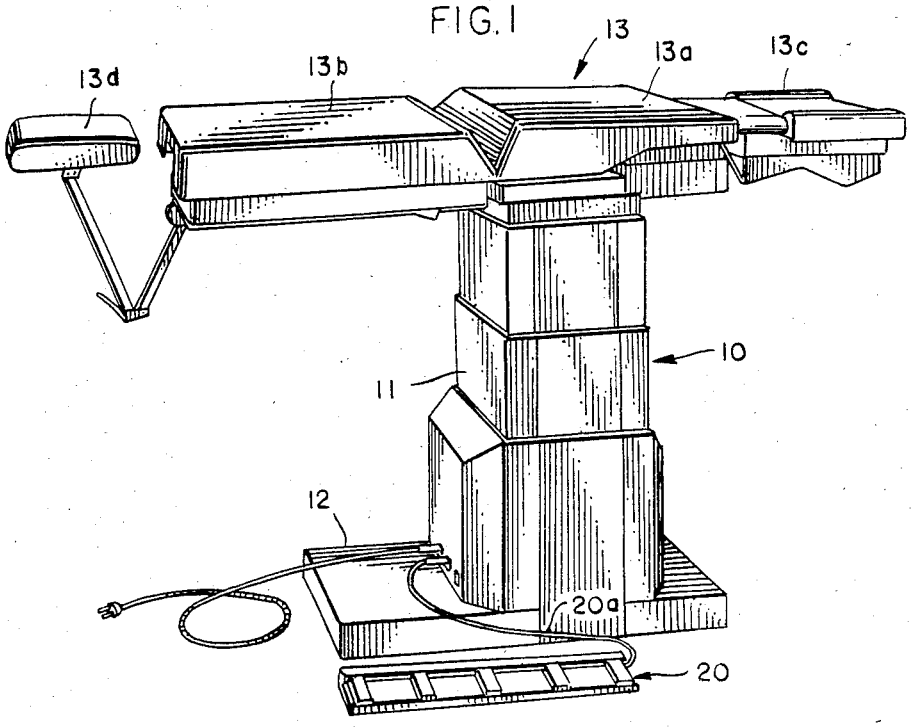
FIG. 1 is a perspective view of a power-operated examination table equipped with a controller embodying this invention.

Referring to the drawings, the numeral 10 generally designates a medical examination table having a power-operated telescoping pedestal 11, a base 12, and a top 13 composed of seat section 13*a*, back section 13*b*, foot and leg support section 13*c*, and headrest section 13*d*. The seat, backrest, and leg support sections 13*a*–13*c* are all hingedly connected and may be adjusted under power into any of a variety of selected positions. Similarly, the telescoping pedestal 11 may be extended or retracted under power, and the seat section 13*a* may be power-driven into rearwardly and forwardly tipped positions when the table is to be adjusted into a Trendelenburg or reverse Trendelenburg position. Such power operation is produced by several electric motors that are concealed within the base and/or top sections and are not visible in the drawings; as well known in the art, other types of power drives, such as hydraulic motors or a combination of electric and hydraulic power systems, might be used. The entire structure has been described as a "table" but it might also be regarded as a chair since it is fully capable of being used as an examination chair when the pedestal is lowered, the backrest fully raised, and the legrest lowered. It is to be understood that the table/chair 10 depicted in FIGS. 1–5 is shown only for purposes of illustration and that the invention disclosed herein might be used in conjunction with other types of power-operated multi-position tables, chairs, and the like. The particular examination table shown is a Model 1K2 table, Hamilton Industries, Two Rivers, Wis.

The foot control assembly 20 depicted in the drawings is electrically connected to the table and includes a flat, elongated housing 21 having a top wall or panel 22, rear wall 34, front wall 24, end walls 25, and bottom wall 26. The illustrated housing is intended to rest upon a floor surface and, to reduce slipping movement on such a surface, the bottom wall or panel may be provided with anti-friction floor pads 26*a* formed of textured rubber or other suitable material. Although the controller 20 is shown as a separate unit connected by an electrical umbilical cord to the table base, it should be understood that the controller may be provided as part of the base, be located slightly above (but in closed proximity to) the floor surface, and may be operatively connected for hydraulic or fluidic actuation rather than electrical actuation of the drive mechanisms.

A plurality of actuating members are spaced apart along top wall 22 for lateral contact with the foot of a user. In the drawings, five such members 27*a*–27*e* are shown, but it is to be understood that a greater or lesser number may be provided (and the width of the housing increased or decreased accordingly) depending on the number of reversible power functions to be performed by the table 10. In the illustration given, there are four such reversible functions requiring a minimum of five actuating members.

Figure 6:
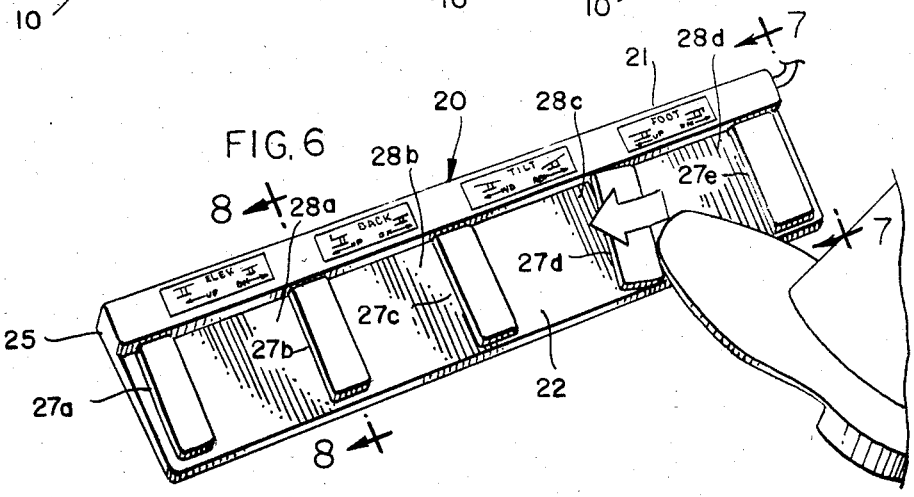
FIG. 6 is a perspective view illustrating the controller and its method of operation.
Figure 7:
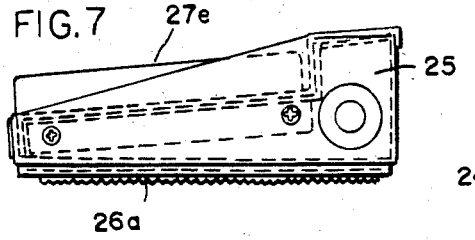
FIG. 7 is an end elevational view taken along line 7—7 of FIG. 6.

Members 27*a*–27*e* are spaced uniformly apart and, in the embodiment illustrated, are normally disposed in parallel relation. The space between each adjacent pair of members, and the planar surface of the top panel between such a pair of members, constitutes an operating station for receiving and slidably supporting the front portion (at least the toe portion) of an operator's foot. Four operating stations 28*a*–28*d* are provided by the foot control assembly 20 represented in the drawings. The width of each station—that is, the distance between an adjacent pair of actuating members in their neutral or parallel positions—should fall within the range of about 3 to 8 inches, the preferred distance being approximately 4 to 6 inches. Such spacing allows the toe portion of an operator's foot to be advanced into an operating station without engaging more than a single actuating member (FIG. 6).

Figure 8:
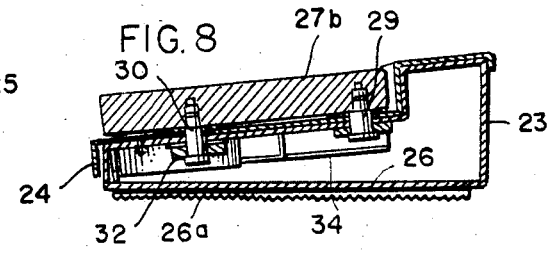
FIG. 8 is a transverse vertical sectional view taken along line 8—8 of FIG. 6.

While the planar top wall 22 has been described as being generally horizontal, ideally it has a slight rearward and upward slope as shown most clearly in FIG. 8. A slope of approximately 6 degrees is illustrated and, in general, such slope should fall within the range of 0 to 20 degrees from the horizontal, with an angle within the range of 3 to 10 degrees being preferred. The particular angle selected may depend partly on the height of the actuating members above a floor surface as measured at the front of the controller. That dimension, which corresponds to the height of front wall 24, is approximately 0.5 inches in the illustrated embodiment and, in any event, should be no greater than about 1.0 inches. Such an arrangement permits a user to operate the foot control assembly with the toe portion of one foot while maintaining full weight upon the heel placed on the floor directly in front of the assembly. During such operation, the heel is utilized as a pivot for foot movement with the toe portion being slid laterally one way or the other over the planar surface 22 at a selected control station to contact one or the other of a pair of actuating members and thereby activate a selected power operation of table 10.

Figures 9, 10, 11:
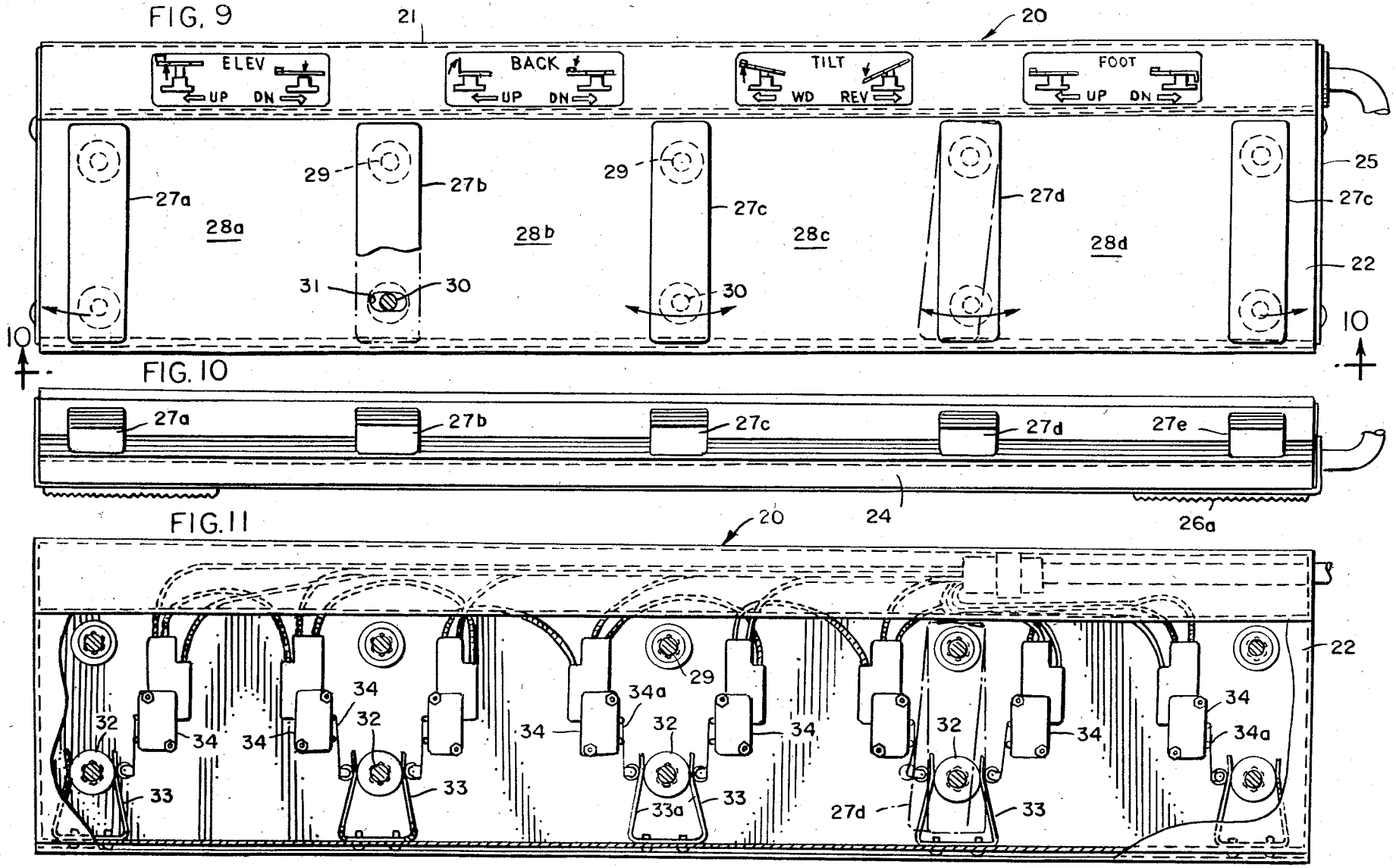
FIG. 9 is an enlarged top plan view of the foot control assembly.
FIG. 10 is a front elevational view taken along line 10—10 of FIG. 9.
FIG. 11 is a top plan view similar to FIG. 9 but with the actuating members removed and top panel cut away to reveal inner components of the assembly.

In the illustrated embodiment, each actuating member 27*a*–27*e* is elongated in a forward-rearward direction with respect to the housing 21 and is generally rectangular in configuration. A pivot pin 29, oriented with its axis normal to the plane of top wall 22, connects the rear portion of each member to the top wall (FIG. 8). Near its front end, each member is equipped with a second depending pin or threaded stud 30 that extends downwardly through a laterally elongated slot 31 in the top wall 22 (FIG. 9), the stud or pin 30 being equipped at its lower end beneath the top wall with a ring or washer 32 (FIG. 8) to provide an enlarged bearing element.

U-shaped springs 33 are secured to the front wall 24 within the housing and are arranged so that the arms 33*a* of each spring bear against the enlarged lower end or bearing member 32 to maintain each actuating member in a neutral position. Each member is also shown to be associated with at least one microswitch 34 mounted beneath top wall 22 with the activating arm 34*a* of the switch having its free end engaging either a spring arm 33*a* (as shown) or directly engaging bearing member 32. It will be noted that while the acutating members 27*a* and 27*e* at the extreme ends of the foot control assembly 20 are each associated with only a single microswitch 34, the remaining members 27*b*–27*d* are each associated with a pair of such switches. Furthermore, since each operating station 28*a*–28*d* is bordered along opposite sides by a pair of actuating members, each station is associated with a pair of microswitches 34 that are electrically connected to the table 10 for activating a particular function in either of two reversible directions.

Figure 2:
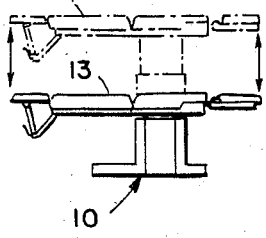
FIGS. 2–5 illustrate four typical adjustments that such a power-operated table is capable of performing.
Figure 3:
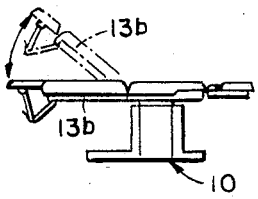

As examples, FIGS. 2–5 illustrate four power-driven reversible table operations capable of being controlled at operating stations 28*a*–28*d* of foot control assembly 20. The raising and lowering operation depicted in FIG. 2 is controlled at station 28*a* by movement of the foot into operative contact with one of the actuating members 27*a* and 27*b*. If member 27*a* is engaged and shifted laterally, the normally-open microswitch 34 associated with that member is closed to complete the circuit that actuates the driving motor for elevating the table. Conversely, if member 27*b* is engaged, the motor is activated by the closing of another microswitch associated with member 27*b*. The same member 27*b*, when contacted and shifted laterally in the opposite direction by toe action in the second operating station 28*b*, causes the closing of a second microswitch associated with member 27*b* that activates a motor causing the back section 13*b* of the table to be raised (FIG. 3). Thus, the same member 27*b* is electrically connected to activate two different functions (lowering the table or raising the backrest) depending on whether it is shifted to the right by toe action at operating station 28*a* or to the left by toe action occurring in operating station 28*b*.

Figure 4:
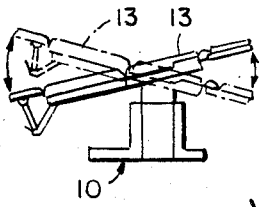
Figure 5:
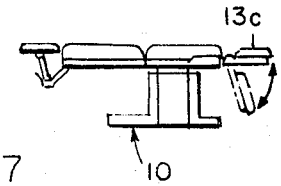

FIG. 4 depicts the reverse Trendelenburg and Trendelenburg positions that are initiated at station 28*c* by lateral foot contact with actuating members 27*c* and 27*d*, respectively. Member 27*c* is therefore electrically connected either to activate a lowering of backrest 13*b* (by outward toe action to the right in operating station 28*b*) or to tilt the entire top 13 into a reverse Trendelenburg position (by outward toe movement to the left in operating station 28*c*). Similarly, member 27*d*, when shifted to the right from station 28*c*, causes the table top to be power driven into a Trendelenburg position (broken lines in FIG. 4) or, if shifted to the left from station 28*d*, causes the legrest 13*c* to be raised into coplanar position with the seat as shown in solid lines in FIG. 5. Member 27*e*, also operated from station 28*d*, is electrically connected to cause a lowering of the legrest when that member is urged to the right. Therefore, unlike a conventional foot control assembly where a single pedal may be depressed either at its front end or at its rear end to activate either of two reverse power operations, the control assembly of this invention requires two actuating members to perform each of the two reverse operations, such members being engaged from a single operating station located therebetween to close the electrical contacts required to initiate such operations.

Since each of the actuating members 27*a*–27*e* of the illustrated embodiment requires a sideways motion for activation, and since accidental activation has been found to arise most frequently when a user accidentally steps on some part of a conventional control assembly and inadvertently depresses one of the pedals, it is believed apparent that the present construction is less subject to unintentional activation and that a protective guard or cage extending over the actuating members, as found in prior constructions, is not required. In addition, the foot action required to operate the actuating member of the assembly disclosed herein is a relatively natural and comfortable action as compared to that required for the operation of at least some of the foot pedal arrangements found in the prior art. Since only toe movement is required to operate the members at any given station, a user may operate the controller without redistributing his (her) weight and without changes in body position that might be undesirable during patient examination or surgical procedures.

While in the foregoing I have disclosed an embodiment of the invention in considerable detail for purposes of illustration, it will be understood by those skilled in the art that many of these details may be varied without departing from the spirit and scope of the invention.

I claim:

1. A foot control for power-operated equipment having reversible power-driven functions, comprising a housing adapted to extend along a floor surface; said housing having at least three actuating members spaced laterally from each other to define at least two adjacent operating stations; each of said adjacent operating stations being wide enough to receive at least the toe portion of an operator's foot between the actuating members defining the same; one of said actuating members being disposed between and partially defining both of said actuating stations; each of said actuating members being mounted upon said housing for horizontal movement from a neutral position towards and away from the operating station immediately adjacent thereto; spring means urging and normally maintaining said actuating members in their neutral positions; first means operatively associated with two of said actuating members defining one of said stations for activating a first of said reversible power functions; second means operatively associated with two of said actuating members defining a station adjacent said one station for activating a second of said reversible power functions; said one of said actuating members disposed between said adjacent operating stations being operatively associated with both of said first and second means for selectively actuating each of said first and second power functions.

2. A foot control for power-operated equipment having reversible power-driven functions, comprising a housing adapted to rest upon a floor surface, said housing having at least three actuating members spaced laterally from each other to define at least two adjacent operating stations with one of said actuating members being disposed and partially defining said two adjacent operating stations; each operating station being wide enough to receive at least the toe portion of an operator's foot between two of said actuating members; each actuating member being mounted upon said housing for lateral movement from a neutral position towards and away from the operating station adjacent thereto; spring means urging and normally maintaining said actuating members in their neutral positions; an electrical switching means operatively associated with the actuating members of each of said stations for activating a reversible power function of said power-operated equipment connected to said foot control when such actuating member is urged by an operator's foot in a lateral direction away from the station receiving the toe portion of such foot; the reversible power function associated with each of said stations being different with said one actuating member disposed between said two adjacent operating stations being operatively associated with a pair of said switching means for activating each of said different power functions depending on the direction of lateral movement of said one actuating member.

3. The foot control of claim 2 in which said housing has horizontally elongated top, front, and rear walls; said actuating members extending in directions between said front and rear walls and being pivotally supported upon said top wall.

4. The foot control of claim 3 in which each of said actuating members is elongated in a direction extending forwardly and rearwardly with respect to said housing.

5. The foot control of claim 2 in which the width of said station falls within the range of about 3 to 8 inches.

6. The foot control of claim 5 in which the width of said station falls within the range of about 4 to 6 inches.

7. A foot control assembly for power-operated equipment having a plurality of reversible power-driven functions, comprising a generally flat housing having laterally elongated top and rear walls and being adapted to rest upon a floor surface; said top wall being planar and sloping gradually upwardly and rearwardly; at least three actuating members mounted upon said top wall and spaced laterally from each other to define at least two operating stations therebetween; each station being bordered along its sides by a pair of said actuating members and being wide enough to receive at least the toe portion of an operator's foot between said pair of members; each member being mounted upon said top wall for lateral movement from a neutral position towards and away from each operating station immediately adjacent thereto; spring means urging and normally maintaining said members in their neutral positions; and electrical switching means operatively associated with each member for activating a reversible power function of said power-operated equipment connected to said foot control assembly when such member is urged laterally by an operator's foot in a direction away from the station receiving the toe portion of such foot; each of said stations being associated with a different power function with each actuating member disposed between two adjacent stations being operatively associated with a pair of said electrical switching means for activating the different power functions of said two adjacent stations depending on the direction of lateral movement of such actuating member.

8. the foot control assembly of claim 7 in which the width of each station falls within the range of about 3 to 8 inches.

9. The foot control assembly of claim 8 in which the width of each station falls within the range of about 4 to 6 inches.

10. The foot control assembly of claim 7 in which said planar top wall slopes upwardly and rearwardly at an angle no greater than about 20°.

11. The foot control assembly of claim 10 in which said angle falls within the range of 3° to 10°.

12. The foot control assembly of claim 7 in which each of said actuating members is elongated in a forward-rearward direction with respect to said housing.

13. The foot control assembly of claim 12 in which said housing also includes a front wall adjacent the front ends of said actuating members; said front wall having a height no greater than about one inch.

* * * * *